US005454593A

United States Patent [19]

Armstrong et al.

[11] Patent Number: 5,454,593

[45] Date of Patent: Oct. 3, 1995

[54] METAL IGNITER TUBE BOOT WITH PERMANENT RETENTION SYSTEM

[75] Inventors: C. Wallace Armstrong, III, Huntsville; David W. Lindsey, Ogden, both of Utah

[73] Assignee: Morton International, Inc., Chicago, Ill.

[21] Appl. No.: 100,795

[22] Filed: Aug. 2, 1993

[51] Int. Cl.[6] ..... B60R 21/26

[52] U.S. Cl. ..... 280/741; 102/530; 280/728.1

[58] Field of Search ..... 280/741, 728 R; 102/530, 531; 422/164, 165, 166, 305

[56] References Cited

U.S. PATENT DOCUMENTS

| | | | |
|---|---|---|---|
| 1,016,648 | 2/1912 | Snell | 422/305 |
| 2,466,561 | 4/1949 | Standal | 102/530 |
| 3,985,076 | 10/1976 | Schneiter et al. | 422/166 |
| 4,005,876 | 2/1977 | Jorgensen et al. | 280/741 |
| 4,203,787 | 5/1980 | Schneiter et al. | 149/35 |
| 4,296,084 | 10/1981 | Adams et al. | 422/166 |
| 4,369,079 | 1/1983 | Shaw | 149/2 |
| 4,380,346 | 4/1983 | Davis et al. | 280/736 |
| 4,547,342 | 10/1985 | Adams et al. | 422/166 |
| 4,561,675 | 12/1985 | Adams et al. | 280/734 |
| 4,950,458 | 8/1990 | Cunningham | 422/164 |
| 5,005,486 | 4/1991 | Lenzen | 102/531 |
| 5,109,772 | 5/1992 | Cunningham | 102/175 |
| 5,345,875 | 9/1994 | Anderson | 280/741 |

*Primary Examiner*—Eric D. Culbreth
*Attorney, Agent, or Firm*—Gerald K. White

[57] ABSTRACT

A permanently installed metal retainer for an air bag gas generator igniter tube end closure is tapered press fit for ease of installation, sealing, and enhanced retention, and includes a final crimp into a suitably positioned groove on the end of the igniter tube for positive retention.

12 Claims, 3 Drawing Sheets

FIG. 4
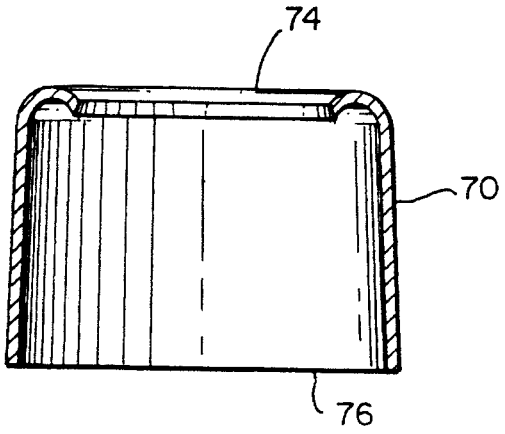
FIG. 6
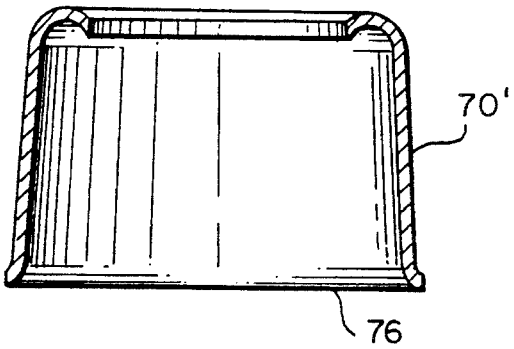
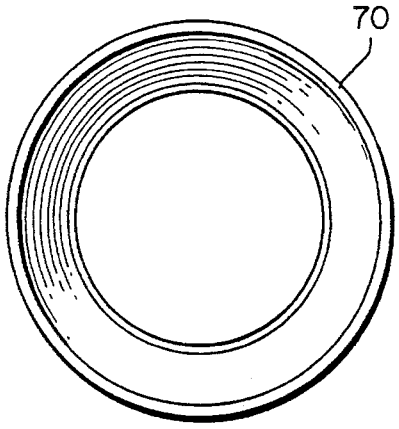
FIG. 5
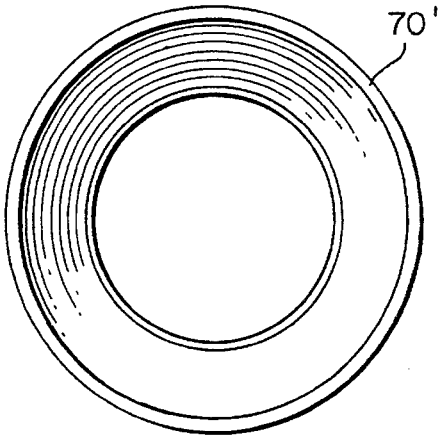
FIG. 7

METAL IGNITER TUBE BOOT WITH PERMANENT RETENTION SYSTEM

BACKGROUND OF THE INVENTION

1. Field of the Invention

This invention relates to an improvement in the mechanism for igniting a gas generator or inflator of the type that utilizes the combustion of a solid fuel gas generant composition for the generation of a gas to inflate an inflatable crash protection air bag or cushion. The invention is particularly advantageous for use in a gas generator provided on the passenger side of an automotive vehicle.

2. Description of the Related Art

Typically, a solid fuel gas generator for the passenger side of an automotive vehicle is elongated. In one embodiment, the gas generator has a length of 11.82 inches (30.02 cm) and an overall diameter of 2.43 inches (6.17 cm). An elongated tubular outer housing for the generator advantageously may be made of aluminum. For most of the length thereof, the outer housing has a relatively thin cylindrical wall in which a plurality of gas exit holes or ports are provided.

One end of the outer housing, termed the stud end, is closed by material formed integrally therewith and includes a threaded stud projecting therefrom. The other end of the outer housing, termed the base end, is closed by a flange. The flange member is attached in a sealing manner to the base end of the outer housing by a suitable process such as inertia welding. A welding process that may be employed is described in U.S. Pat. No. 4,547,942 to Adams et al., which patent is assigned to the assignee of the present invention and the disclosure of which, by reference, is incorporated herein. The flange member serves as a squib and initiator holder.

Extending for a substantial portion of the length of the outer housing and centrally thereof so as to be generally concentric therewith, is an elongated generally cylindrical tubular member comprising an igniter tube. The igniter tube contains ignition granules of an appropriate pyrotechnic material capable of providing rapid deflagration. A squib and initiator are provided in operative relation with and close to the end of the igniter tube that is adjacent to the base end of the housing. At the stud end of the housing the igniter tube is closed by a rubber boot. The rubber boot incorporates an ignition granule retention disk.

A tube locator cap comprising a silicone pad is positioned adjacent to the inner side of the integrally formed end at the stud end of the housing and a retaining cup is positioned adjacent the inner side of the base end of the housing for facilitating positioning of the igniter tube and for retaining it in place. A retainer disk is provided to keep the retaining cup and the gas generant material in place within the housing during the assembly operation, suitably spaced from the flange member which spins relatively to the base end of the housing during the inertia welding operation.

Also extending over a substantial portion of the length of the tubular housing and positioned concentrically therein is an elongated perforated cylindrical inner tube or basket. The inner tube is positioned concentrically relatively to the igniter tube and outer housing by means of a circular groove in a silicone pad at the stud end of the housing and by a silicone pad positioned against the retainer disk adjacent to the flange member at the base end of the housing.

Gas generant material is contained in an elongated space or region having an annular cross section between the igniter tube and the inner tube or basket. The annular space is the combustion or gas generant chamber of the gas generator.

Upon initiation of gas generation, generated gases flow from the combustion chamber through perforations in the perforated inner tube into a radially outward space or region having an annular cross section located between the inner tube and the inner wall of the housing. A gas filtering assembly is positioned in this radially outward positioned space. Positioned between the filtering assembly and the wall of the housing is a foil seal barrier.

In the operation of a gas generator as described herein, several problems have been encountered involving post fire flammable outgassing. This is the result of non-pyrotechnic flammables from inside the gas generator. In addition the rubber boot on the end of the igniter tube is susceptible to being pulled off or forced over the igniter tube during installation or assembly anomalies. Such displacement of the rubber boot tends to result in loss of ignition granules from the igniter tube which can cause ignition irregularities.

Thus, there is a need and a demand for an improved igniter system for the passenger air bag gas generator that provides a positive retention system for the ignition granules in the igniter and will withstand installation anomalies and last for the lifetime of environments experienced by the gas generator assembly.

SUMMARY OF THE INVENTION

An object of the invention is to provide an improvement to the igniter tube and guide boot of a passenger air bag gas generator or inflator for effecting the elimination of post fire flammable off-gassing and for providing a positive retention system for closing the end of the igniter tube at the stud end of the gas generator.

Another object of the invention is to provide a durable guide boot for an igniter tube which will not be potentially damaged during installation processes.

A further object of the invention is to provide a permanently installed non-pyrotechnic, non-flammable retainer boot or cap for a gas generator ignition system igniter tube end closure, which boot or cap comprises a cylindrical tube made of a metal such as aluminum and is tapered, press fit for ease of installation, sealing and enhanced retention, is positively retention/crimped onto the end of the igniter tube, and incorporates an ignition granule retention disk.

In accomplishing these and other objectives of the invention there is provided a metal boot or cap closure for the end of an ignition system igniter tube. The closure incorporates an ignition granule retention disk which is capable of having a flame front pass through the disk. The closure provides a seal fit with positive retention/crimping onto the igniter tube.

The invention incorporates both an interference fit of the metal closure onto the igniter tube and crimping of the leading edge thereof into a suitably positioned groove on the igniter tube. The ignition granule retainer disk is provided with an interference fit into the full depth of the closure and seats against the end of the igniter tube when installed.

The closure, in a preferred version according to the invention, is designed as a tapered cylinder with a radially inwardly curved and slightly inverted trailing edge for holding the ignition granule retention disk against the end of the igniter tube, and with a flared leading edge for ease of installation on the end of the igniter tube.

BRIEF DESCRIPTION OF THE DRAWINGS

With this description of the invention a detailed description follows with reference being made to the accompanying drawings which form part of the specification and in which like parts are designated by the same reference numerals, of which drawings:

FIG. 4 is a cross sectional view of a metal boot or cap closure provided, according to the invention, as a replacement for a rubber boot to close the end of an ignition system igniter tube;

FIG. 5 is a view of the metal boot or cap closure shown in FIG. 4 from the larger open end thereof;

FIG. 6 is a cross sectional view of a modified and preferred metal boot or cap closure, according to the invention, as a replacement for a rubber boot to close the end of an ignition system tube;

FIG. 7 is a view of the metal boot or cap closure shown in FIG. 6 from the larger open end thereof;

DESCRIPTION OF THE PREFERRED EMBODIMENT

Figure 1:
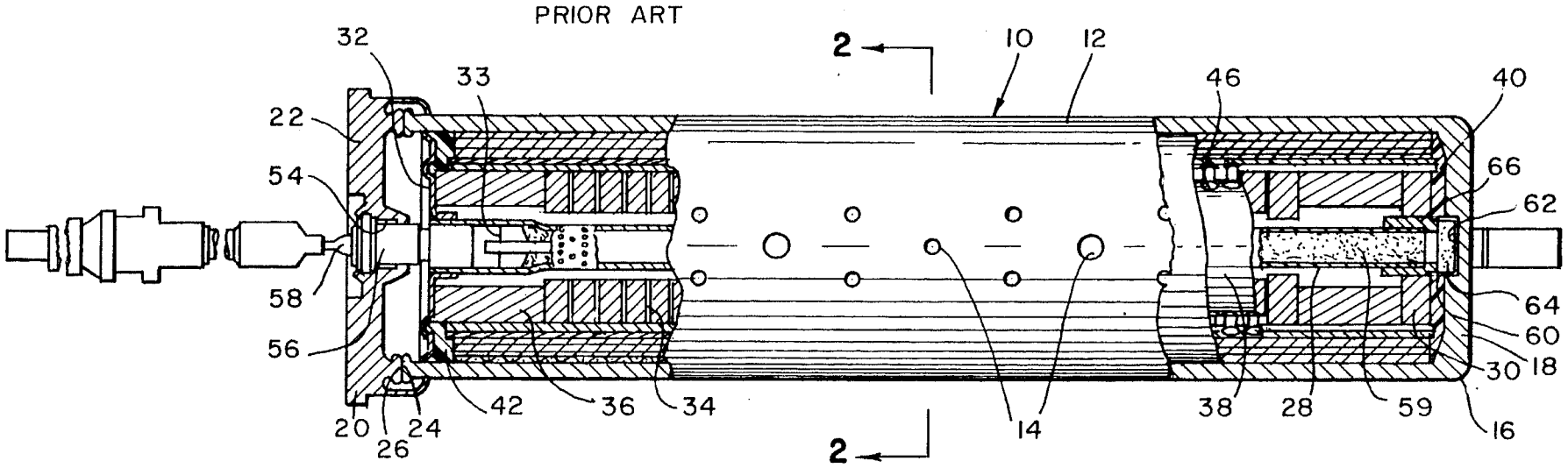
FIG. 1 is a longitudinal partially cross sectioned view of a prior art gas generator or inflator in which a rubber igniter boot is utilized to close the end of the igniter tube adjacent to the stud end of the gas generator.

The prior art gas generator or inflator indicated at 10 in FIG. 1 of the drawings is useful in an automotive vehicle crash protection cushion restraint system that includes an air bag (not shown). The generator 10 is particularly adapted for use on the passenger side of the vehicle, being mounted in an appropriate manner in or on the dashboard of the vehicle.

The gas generator 10, as shown, includes an elongated tubular outer housing 12 made of aluminum. For a substantial portion of the length thereof, the outer housing 12 has a thin cylindrical wall in which a plurality of gas exit outlets or holes 14 are provided.

One end 16 of the housing 12, termed the stud end, is closed by a member 18 which, as shown in FIG. 1, may be formed integrally therewith. The other end 20 of the housing 12, termed the base end, is closed by a squib holder and flange member 22. Member 22 may be attached in a sealing manner to the end of housing 12 by a suitable process such as by inertia welding, as illustrated by welds 24. Adjacent the periphery of the inner surface of the flange member 22 is a circular ridge 26 that is welded to the adjacent end of the housing 12 during this process.

Extending generally over the length of tubular member 12 and centrally located thereof so as to be generally concentric therewith is an elongated generally cylindrical perforated tubular member 28. Member 28 functions as an igniter tube.

An igniter tube locator silicone pad 30 is positioned adjacent the inner side of stud end member 18. A retainer disk 32 and igniter tube retaining cup 33 are positioned adjacent the inner side of the base end flange member 22 for facilitating positioning of the igniter tube 28 for retaining it in place. The retainer disk 32 serves also to keep gas generant material comprising a plurality of wafers 34 which are arranged in a side-by-side spaced apart array in place within the housing 12. During the assembly operation, the retainer disk 32, by means of an annular spacer 36, keeps the gas generant wafers 34 suitably spaced apart from the flange member 22 which spins relatively to the housing 12 during the inertia welding operation.

Also extending generally over the length of the tubular housing 12 and positioned concentrically therein is an elongated perforated cylindrical inner tube or basket 38 which my be composed of mild steel or other material. Basket 38 is positioned concentrically relatively to the flash igniter tube 28 and housing 12 by means of a circular groove in a silicone pad 40 at the stud end 16 of housing 12 and by a silicone pad 42 at the base end 20 of housing 12.

Figure 2:
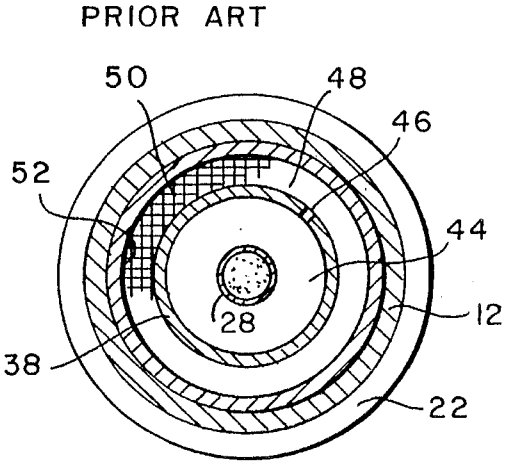
FIG. 2 is a cross sectional view of the gas generator of FIG. 1 taken on the lines 2—2.

The gas generant wafers 34 are contained in an elongated space or region 44 having an annular cross section, as best seen in FIG. 2, between the flash igniter tube 28 and the basket 38. The annular space 44 forms and is referred to hereinafter as the combustion or gas generant chamber of the inflator 10. The wafers 34 have the shape of washers with the inner and outer diameters thereof being generally the same as the inner and outer diameters, respectively, of the annularly shaped combustion chamber 44.

Generated gases flow from the combustion chamber 44 through perforations 46 in the perforated basket 38 into an annular space 48 between the basket 38 and the inner wall of the housing 12. A gas filtering assembly 50 is positioned in the annular space 48. Positioned between the filtering assembly 50 and the inner wall of the housing 12 is a heat seal foil barrier 52 which may have a thickness of 0.004 inches (0.010 cm).

The gas filtering assembly 50 is annular in cross section. By way of example but not limitation, the gas filtering assembly 50 may include, beginning with the innermost layer, next to the basket 38, two wraps of nickel coated carbon or stainless steel 30 mesh screen, then metal filter such as 80×700 or 50×250 mesh stainless steel or 40×180 mesh nickel coated carbon, then a single wrap of ceramic filter paper 0.080 inches (0.203 cm) thick, followed by two wraps of 30 mesh stainless steel or nickel coated carbon. Lastly, a wrap of 5 mesh stainless steel or nickel coated carbon may be provided adjacent the wall of the housing 12 to allow space around exit ports or holes 14 therein for the free passage of the generated gases. The gas filtering assembly 50, however, may contain any other suitable filtering arrangement.

Adjacent the inner wall of the perforated basket 38 within the combustion chamber 44 may be disposed two or three wraps of 30 mesh nickel coated carbon or stainless steel cooling screen (not shown).

The gas generant wafers 34 may be made from one of a number of compositions meeting the requirements of burning rate, non-toxicity and flame temperature. One composition that may be utilized is that described in U.S. Pat. No. 4,203,787 to Schneiter et al. Another composition that may be used advantageously is that described in U.S. Pat. No.

4,369,079 to Shaw. Both of these patents, the disclosures of which by reference are incorporated herein, are assigned to the assignee of the present invention.

The present invention is not limited to any particular composition or geometrical shape of the gas generant material in the combustion chamber 44. Thus, the gas generant material may comprise a charge of pyrotechnic material in the form of pellets which may be similar to the pellets of gas generant material disclosed in the aforesaid U.S. Pat. No. 4,547,342.

By way of example and not limitation, it is noted that the igniter tube 28 may comprise an eleven (11) inch (27.94 cm) long 21 gage hollow cylindrical body of carbon steel having an outside diameter of three-eighths (⅜) of an inch (0.95 cm) that has been coated with iron phosphate or aluminized and into which perforations have been introduced by piercing the cylindrical wall thereof. Alternatively, the igniter tube 28, again having a length of eleven (11) inches (27.94 cm), may be made of 30 mesh carbon steel screen coated with iron phosphate or aluminized, rolled and welded into a tube having an outside diameter of three-eighths (⅜) of an inch (0.95 cm).

Pressed into a centrally positioned aperture 54 of the flange member 22 at the base end 20 of housing 12 is an initiator assembly 56 which includes a suitable squib (not shown). The squib and initiator assembly 56 are positioned in the adjacent end of the igniter tube 28 and are connected by wires 58 which lead to a source of electrical power for initiating ignition of the gas generator 10.

Contained within the initiator assembly 56 is a suitable pyrotechnic material comprising granules 59 which may be any of a variety of compositions meeting the requirements for rapid ignition and non-toxicity. A typical material for this use may be $BKNO_3$ powder. The pyrotechnic material is ignitable by the squib (not shown ) .

As shown in FIG. 1, a container 60 is provided in a recess 62 in the inner wall of member 18 at the stud end 16 of housing 12 in alignment with the adjacent end of the flash igniter tube 28. Container 60 holds or contains auto ignition granules 64 to define an auto ignition device similar to the auto ignition device disclosed in U.S. Pat. No. 4,561,675 to Adams et al. and assigned to the assignee of the present invention, which patent, by reference, is incorporated herein. The granules 64 are ignitable to cause the pyrotechnics in the gas generator 10 to function when subjected to a high temperature environment, such as a bonfire, at a temperature in the 350° F. range instead of the 650° F. range at which the gas generator pyrotechnics would ignite if the auto ignition device were not provided. This enables the use of aluminum for the gas generator housing 12, the aluminum having sufficient high temperature properties to contain the internal auto ignition pressures that are produced at a temperature of 350° F. but not at 650° F. The housing 12 is preferably composed of aluminum in order to minimize the weight of the gas generator 10.

Figure 3:
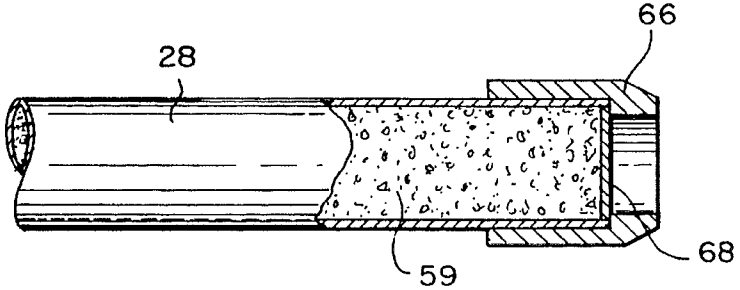
FIG. 3 is a fragmented enlarged cross sectional view of the igniter tube with an attached rubber igniter boot and ignition granule retention disk utilized in the prior art gas generator shown in FIGS. 1 and 3.

At the end of the igniter tube 28 that is adjacent the stud end 16 of housing 12, as best seen in FIGS. 1 and 3, the igniter tube 28 is closed by a rubber boot 66 and an ignition granule retention disk 68. The rubber boot 66 is made of a non-pyrotechnic flammable material. Being located inside the gas generator 10, it is the source of a problem giving rise to post fire flammable outgassing during the generation of gas by the gas generator 10. In addition, during the installation or assembly of the gas generator 10, the rubber boot 66 potentially is capable of being influenced by installation anomalies and pulled off or forced over the igniter tube.

In accordance with the invention, as shown in FIGS. 4–9, there has been provided a non-pyrotechnic, non-flammable metal boot or cap closure 70 and an incorporated ignition granule retention disk 72 for closing the end of the end of the ignition system igniter tube 28 adjacent the stud end of the gas generator outer housing 12. At the smaller open or trailing end 74, the wall of the closure 70, as shown in FIG. 4, is curved inwardly and inverted slightly, that is, slightly reversed in direction. Between the open ends 74 and 76, the closure 70 is tapered, that is, the diameter thereof increases, spreading outward by degrees in the direction to the larger or leading end 76.

In a modified and preferred embodiment of the invention, the closure, designated 70' and shown in FIG. 6 differs from the closure 70 in that the open end 76 is flared, that is, widened additionally or spread outwardly for a short distance.

Figure 9:
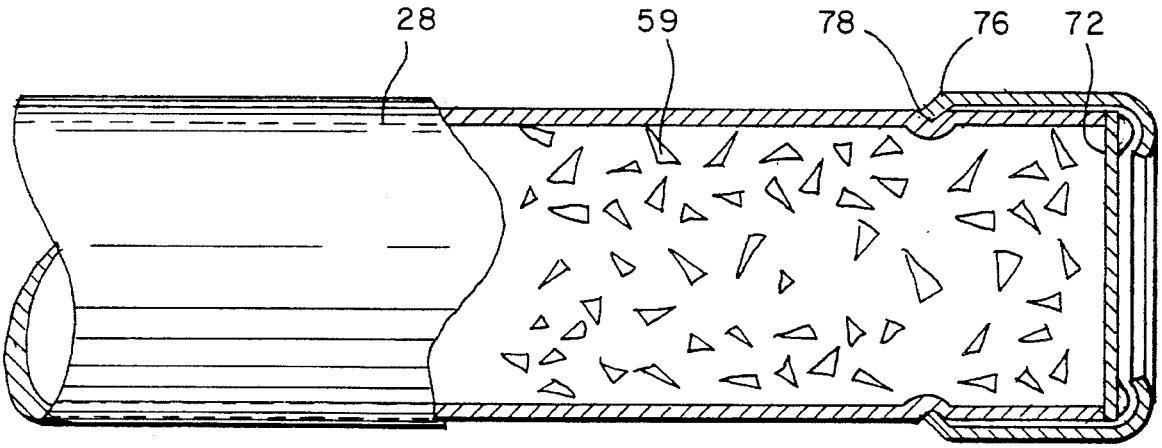
FIG. 9 is a fragmented cross sectioned and partially enlarged view of an ignition system igniter tube having a metal boot or cap closure as shown in either FIG. 4 or FIG. 6 attached to the end thereof and incorporating an ignition granule retention disk seated against the adjacent end of the igniter tube.

Each of the closures 70 and 70' provides a seal fit with positive retention/crimping onto the igniter tube 28, as shown in FIG. 9, with the larger diameter end 76 crimped into a suitably positioned crimp groove 78 on the igniter tube 28. The metal of which the closures 70 and 70' are made is bendable to allow such crimping.

Figure 8:
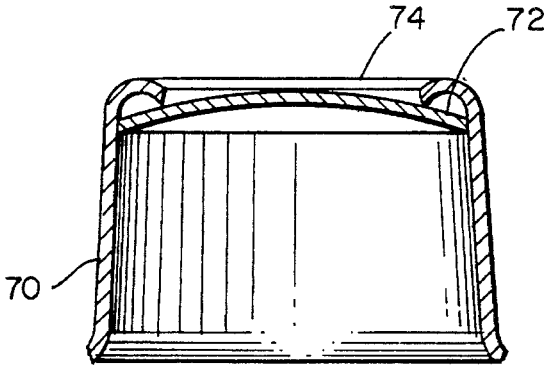
FIG. 8 is a cross sectional view of the modified and preferred metal boot or cap closure shown in FIGS. 6 and 7 with an ignition granule retention disk installed to full depth therein.

This system of attachment of the closure incorporates both an interference fit of the closures 70 and 70' onto the igniter tube 28 and crimping of the leading edge 76 on the igniter tube 28. The ignition granules retention disk 72, as shown in FIG. 8, has an interference fit into the full depth between ends 74 and 76 of the closure 70 and seats against the end of the igniter tube 28, being pressed thereagainst by the open end 74, as shown in FIG. 9, when installed thereon.

While the ignition granule retention disk 72 may be made of any suitable non-pyrotechnic, non-flammable material, a preferred form thereof according to the invention is a wire cloth mesh. So configured the ignition granule retention disk 72 is capable of having a flame front pass therethrough.

This is particularly advantageous in facilitating the auto ignition functioning of the pyrotechnics in the gas generator when subjected to a high temperature environment, such as a bonfire. That is to say, upon ignition of the auto ignition granules 64, as shown in FIG. 1, the flame front produced thereby quickly passes through the igniter granule retention disk 72 and ignites the ignition granules 59 in the igniter tube 28 and causes the pyrotechnics of the gas generator 10 to function.

Thus, in accordance with the invention, there has been provided an improvement to the igniter tube and guide boot of a passenger air bag gas generator for effecting the elimination of post fire flammable off-gassing and for providing a positive retention system for closing the end of the igniter tube at the stud end of the gas generator. There has been provided a durable guide boot for an igniter tube which is not subject to potential damage during installation processes. The system provided is a positive permanent retention system.

With this description of the invention in detail, those skilled in the art will appreciate that modifications may be made to the invention without departing from the spirit thereof. Therefore, it is not intended that the scope of the invention be limited to the specific embodiments illustrated and described. Rather, it is intended that the scope of the invention be determined by the appended claims and their equivalents.

What is claimed is:

1. An igniter tube end closure comprising, a non-pyrotechnic, non-flammable, cylindrical tube tapered, press fit for ease of installation, sealing and enhanced retention on the end of an igniter tube on which said cylindrical tube is to be permanently installed, said cylindrical tube having a leading end and a trailing end, said leading end having a slightly larger diameter than said trailing end and the end of the igniter tube, and said trailing end being radially inwardly curved and slightly inverted.

2. An igniter tube end closure, as defined in claim 1, wherein said leading end of said cylindrical tube is flared slightly.

3. An igniter tube end closure, as defined by claim 1, wherein said cylindrical tube is made of a metal.

4. An igniter tube end closure, as defined by claim 3, wherein said cylindrical tube is made of aluminum.

5. An igniter tube end closure as defined in claim 1, wherein said leading end of said cylindrical tube is bendable to allow crimping thereof into a suitably positioned notch or groove on the end of the igniter tube on which said cylindrical tube is to be installed.

6. An igniter tube end closure, as defined in claim 5, further including a retention disk having a diameter that is substantially the same as that of the end of the igniter tube on which said cylindrical tube is to be installed, said retainer disk having an interference fit in substantially all positions thereof between the ends of said cylindrical tube when installed therein from said leading end thereof, and seating against the end of the igniter tube when so installed, being forced thereagainst by the slightly inverted trailing end of said cylindrical tube.

7. An igniter tube end closure, as defined by claim 6, wherein said leading end of said cylindrical tube is flared slightly for facilitating ease of installation of said cylindrical tube on the end of the igniter tube.

8. An igniter tube end closure, as defined by claim 6, wherein said retention disk comprises a wire cloth.

9. An igniter tube boot for closing a portion of an air bag gas generator ignition system igniter tube containing ignition granules comprising, tapered cylindrical tube having a leading end and a trailing end, said leading end having a larger diameter than said trailing end, and said trailing end being radially inwardly curved and slightly inverted, the portion of said igniter tube being closed by said tapered cylindrical tube being an open end of said igniter tube, further including a retention disk having a diameter that is substantially the same as that of the open end of said igniter tube, said retention disk having an interference fit into all positions thereof between the leading and trailing ends of said cylindrical tube when installed therein from the leading end thereof and seating against the end of said igniter tube when so installed, being forced thereagainst by the slightly inverted end of said trailing end of said cylindrical tube.

10. An igniter tube boot for closing an air bag gas generator ignition system igniter tube containing ignition granules comprising, a tapered cylindrical tube having a leading end and a trailing end, said leading end having a larger diameter than said trailing end, and said trailing end being radially inwardly curved and slightly inverted, wherein said leading end of said tapered cylindrical tube is flared slightly, further including a retainer disk having a diameter that is substantially the same as that of the end of the igniter tube that is to be closed by said tapered cylindrical tube, said retainer disk having an interference fit into all positions thereof between the heading and trailing ends of said cylindrical tube when installed therein from the leading end thereof and seating against the end of said igniter tube when so installed, being forced thereagainst by the slightly inverted end of said trailing end of said cylindrical tube, wherein said leading end of said tapered cylindrical tube is flared slightly for facilitating ease of installation of said cylindrical tube on the end of said igniter tube.

11. An igniter tube boot for closing a gas generator ignition system igniter tube, as defined by claim 10, wherein said retainer disk comprises a wire cloth mesh.

12. An air bag gas generator ignition system igniter tube end closure comprising an ignition granule retention disk, and a tapered cylindrical tube having a trailing edge and a leading edge.

wherein said ignition granule retention disk comprises a wire cloth mesh, said leading edge being flared for ease of installation of said cylindrical tube on the end of the igniter tube; and said trailing edge being radially inwardly curved and slightly inverted for holding said ignition granule retention disk against the end of the igniter tube.

* * * * *